US005890047A

United States Patent [19]

Moser

[11] Patent Number: 5,890,047

[45] Date of Patent: Mar. 30, 1999

[54] EXTERNALLY HEATED NFFR FUSER

[75] Inventor: Rabin Moser, Victor, N.Y.

[73] Assignee: Xerox Corporation, Stamford, Conn.

[21] Appl. No.: 4,758

[22] Filed: Jan. 8, 1998

[51] Int. Cl.[6] ..... G03G 15/20

[52] U.S. Cl. ..... 399/329; 399/330

[58] Field of Search ..... 399/329, 320, 399/328, 330, 331, 333; 118/60; 219/216

[56] References Cited

U.S. PATENT DOCUMENTS

| | | | |
|---|---|---|---|
| 4,242,566 | 12/1980 | Scribner | 219/216 |
| 4,582,416 | 4/1986 | Karz et al. | 399/329 |
| 4,922,304 | 5/1990 | Titterington | 399/322 |
| 5,250,998 | 10/1993 | Ueda et al. | 399/329 |
| 5,349,424 | 9/1994 | Dalal et al. | 399/329 |
| 5,465,146 | 11/1995 | Higashi et al. | 399/328 |

*Primary Examiner*—Arthur T. Grimley
*Assistant Examiner*—Hoan Tran

[57] ABSTRACT

A combination belt and roll fuser has a pair of pressure engageable rolls with a belt looped or wrapped around one of the pressure engageable rolls such that the belt is sandwiched therebetween. The belt is deformed due to the force exerted by the pressure rolls such that it forms a single fusing nip. Substrates carrying toner images pass through the single fusing nip with the toner images contacting the outer surface of the belt. An internally heated, thermally conductive roll contacts a portion of the belt externally at a pre-nip location for elevating its temperature. The pressure engageable roll about which the belt is entrained is internally heated during warm-up for minimizing droop. This belt and roll fuser configuration exhibits the characteristics of a Nip Forming Fuser Roll (NFFR) fuser.

11 Claims, 3 Drawing Sheets

EXTERNALLY HEATED NFFR FUSER

BACKGROUND OF THE INVENTION

This invention relates generally to xerographic image creation apparatus, and more particularly, it relates to the heat and pressure belt fuser for fixing color toner images to a final substrate at high speeds.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a Nip Forming Fuser Roll (NFFR), the heated fuser roll is provided with a layer or layers that are deformable by a harder pressure roll when the two rolls are pressure engaged. The length of the nip determines the dwell time or time that the toner particles remain in contact with the surface of the heated roll.

The heated fuser roll is usually the roll that contacts the toner images on a substrate such as plain paper. In any event, the roll contacting the toner images is usually provided with an abhesive (low surface energy) material for preventing toner offset to the fuser member. Three materials which are commonly used for such purposes are PFA, Viton™ and silicone rubber.

Roll fusers work very well for fusing color images at low speeds since the required process conditions such as temperature, pressure and dwell can easily be achieved. When process speeds approach 100 pages per minute (ppm) roll fusing performance starts to falter. At such higher speeds, dwell must remain constant which necessitates an increase in nip width. Increasing nip width can be accomplished most readily by either increasing the fuser roll (FR) rubber thickness and/or the outside diameter of the roll. Each of these solutions reach their limit at about 100 ppm. Specifically, the rubber thickness is limited by the maximum temperature the rubber can withstand and the thermal gradient across the elastomer layer. The roll size becomes a critical issue for reasons of space, weight, cost, & stripping.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,242,566 granted to Albert W. Scribner on Dec. 30, 1980 discloses a heat and pressure fusing apparatus that exhibits high thermal efficiency. The fusing apparatus comprises at least one pair of first and second oppositely driven pressure fixing feed rollers, each of the rollers having an outer layer of a thermal insulating material; first and second idler rollers, a first flexible endless belt disposed about the first idler roller and each of the first pressure feed rollers and a second flexible endless belt disposed about the second idler roller and each of the second pressure feed rollers, at least one of the belts having an outer surface formed of a thermal conductive material, wherein there is defined an area of contact between the outer surfaces of the first and second belts located between the first and second pressure feed rollers for passing the copy sheet between the two belts under pressure; and means spaced relative to the belt whose outer surface comprises the thermal conductive material for heating the outer surface thereof, whereby when an unfused copy sheet is passed through the area of contact between the two belts it is subject to sufficient heat and pressure to fuse developed toner images thereon.

U.S. Pat. No. 4,582,416 granted to Karz et al on Apr. 15, 1986 discloses a heat and pressure fusing apparatus for fixing toner images. The fusing apparatus is characterized by the separation of the heat and pressure functions such that the heat and pressure are effected at different locations on a thin flexible belt forming the toner contacting surface. A pressure roll cooperates with a stationary mandrel to form a nip through which the belt and copy substrate pass simultaneously. The belt is heated such that by the time it passes through the nip it's temperature together with the applied pressure is sufficient for fusing the toner images passing therethrough.

U.S. Pat. No. 4,922,304 granted to Gilbert et al on May 1, 1990 discloses a fuser belt for a reproduction machine. The belt may have one of several configurations which all include ridges and interstices on the outer surface which contacts the print media. These interstices are formed between regularly spaced ridges, between randomly spaced particles, between knit threads. These interstices allow the free escape of steam from the media during high-temperature fusing of the reproduction process. As the steam escapes freely, the steam does not accumulate in the media causing media deformations and copy quality deterioration. Additionally, media handling is improved because the ridges and interstices reduce the unwanted but unavoidable introduction of thermal energy into the copy media.

U.S. Pat. No. 5,250,998 granted to Ueda et al on Oct. 5, 1993 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,349,424 granted to Dalal et al on Sep. 20, 1994 discloses a heated, thick-walled, belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the heat transfer. The second span of the belt forms an extended fusing nip with a pressure roll. The extended nip provides a greater dwell time for a sheet in the nip while allowing the fuser to operate at a greater speed. External heating enables a thick profile of the belt, which in turn allows the belt to be reinforced so as to operate at greater fusing pressures without degradation of the image. The thick profile and external heating of the belt also provides a much more robust design than conventional thin walled belt fusing systems.

U.S. Pat. No. 5,465,146 granted to Hgashi et al on Nov. 7, 1995 relates to a fixing device to be used in electrophotographic apparatus for providing a clear fixed image with no offset with use of no oil or the least amount of oil, wherein an endless fixing belt provided with a metal body having a release thin film thereon is stretched between a fixing roller having a elastic surface and a heating roller, a pressing roller is arranged to press the surface of the elastic fixing roller upwardly from the lower side thereof through the fixing belt to form a nip portion between the fixing belt and the pressing roller, a guide plate for unfixed image carrying support member is provided underneath the fixing belt, between the heating roller and the nip portion, to form substantially a linear heating path between the guide plate and the fixing belt, and the metal body of the fixing belt has a heat capacity per $cm^2$ within the range of 0.001 to 0.02 cal/°C.

BRIEF SUMMARY OF THE INVENTION

According to the intents and purposes of the present invention, there is provided a heat and pressure belt fuser including a pair of pressure engageable rolls and an externally heated, elastic fusing belt. The pressure engageable rolls and belt are supported such that the belt is sandwiched between the two pressure engageable rolls. The belt and roll about which the belt is looped are provided with one or more deformable layers which cooperate to form a single nip through which substrates carrying toner images pass with the toner images contacting an outer surface of the elastic belt. The external source of heat is provided by contacting the outer surface of the belt in a pre-nip area.

An elastic belt that is externally heated allows for maximum rubber temperatures to be attained at the fusing surface without relying on heat transfer through the belt. Externally heating the belt enables larger belt thicknesses allowing for the increased nip widths necessary for higher process speeds. Higher fusing surface temperatures also enable the use of higher melting toners.

Smaller nip pressure rolls can be used in the belt fuser since the belt thickness, not the roll diameter, may be relied on as the major contributor for generating a large nip. Smaller roll diameters also equate to more reliable stripping. Various combinations of belt thickness and or rubber thickness on the roll are contemplated for producing the desired fusing nip.

The belt architecture also reduces the "Droop" of the fuser to essentially zero. Droop is defined as the reduction in FR surface temperature over time as a function of contact with ambient media and/or a cooler Pressure Roll (PR). With internally heated roll fusers, especially rolls with thick rubber layers, the droop can be significant because of the time it takes to heat through the bulk of the rubber after the paper and pressure roll (PR) start drawing heat from the FR. The effects of droop are inconsistent fix and gloss within a series of prints. The external heating of the belt replenishes the heat quickly at the belt surface prior to the belt re-entering the fusing nip, thereby eliminating the time lag caused by heating through the rubber, in the case of a roll fuser.

The belt also has the potential of being more environmentally friendly since only the rubber needs to be replaced when the fusing surface provided by the belt fails due to poor release, whereas a roll consists of both relatively thick rubber and a metallic core.

DESCRIPTION OF THE PREFERRED EMBODIMENT(S) OF THE INVENTION

Figure 1:
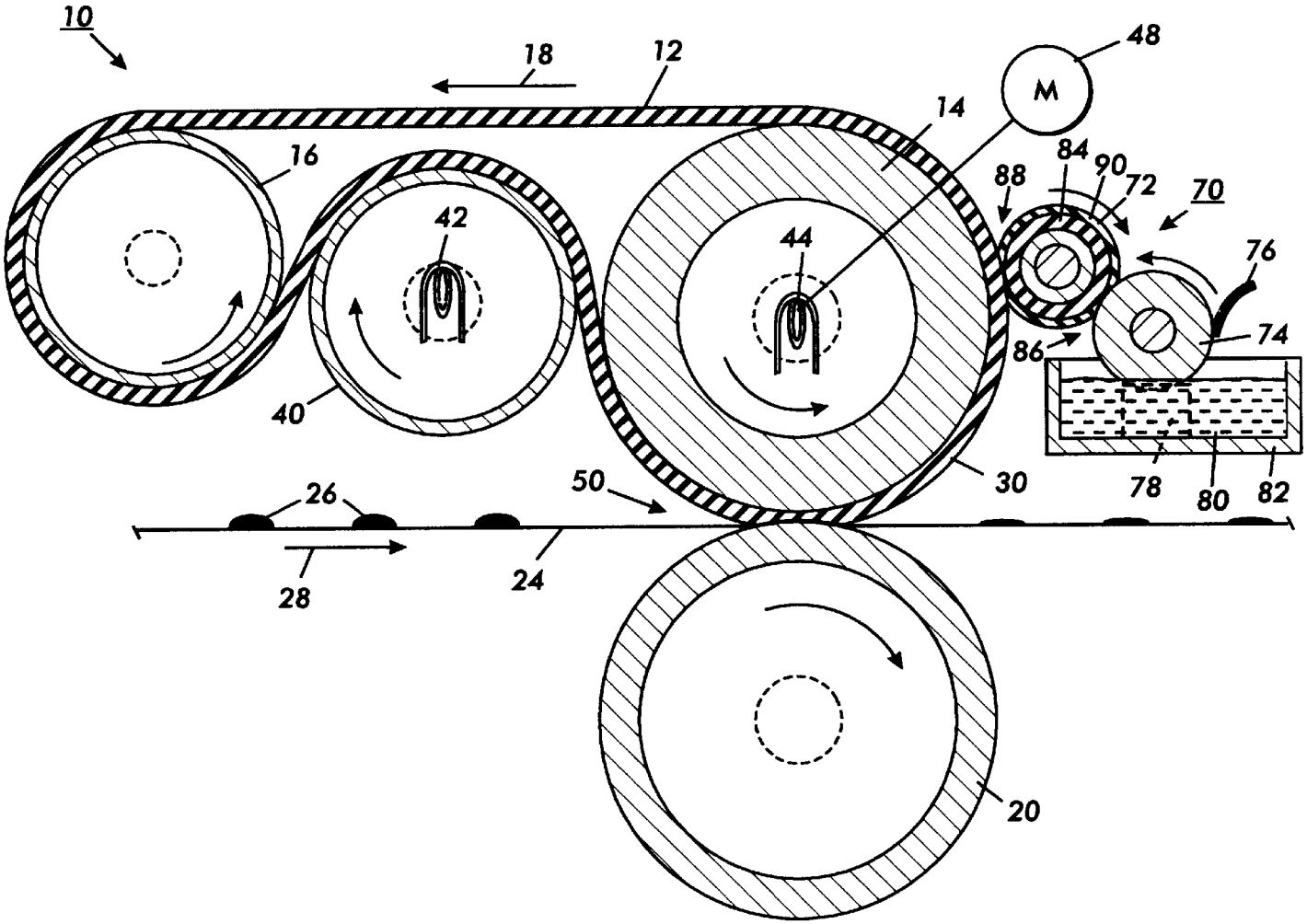
FIG. 1 is a schematic representation of a heat and pressure belt fuser according to the invention.

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

As disclosed in FIG. 1, one embodiment of the present invention comprises a heat and pressure belt fuser indicated generally by the reference character 10. A stretchable or elastic belt 12 is supported for movement in an endless path by a pair of rolls 14 and 16. The roll 14 is one of a pair of pressure engageable rolls while the roll 16 is an idler roll cooperating with the roll 14 to support the belt 12 for movement in and endless loop or path of movement in the direction of the arrow 18. A second pressure engageable roll 20 is supported for pressure engagement with the roll 14 such that the belt 12 is sandwiched therebetween in order to form a fusing nip 50. Imaged substrates such as a sheet of plain paper 24 carrying toner images 26 move in the direction of the arrow 28 pass through the nip 50 with the toner images contacting an outer surface 30 of the belt 12. The fusing nip 50 comprises a single nip, in that, the section of belt contacted by the roll 14 is coextensive with the opposite side of the belt contacted by roll 20. In other words, neither of the rolls 14 and 20 contact a section of the belt not contacted by the other of these two rolls. A single nip insures a single nip velocity through the entire nip.

The deformable belt 12 preferably comprises silicone rubber of the type conventionally utilized in roll fusers. The thickness of the belt 12 is in the order of 0.006 to 0.125 inch. The deformable belt 12 provides the same function as the deformable layer of a Nip Forming Fuser Roll (NFFR), that is, it is self stripping. Also, smaller nip pressure rolls can be used in this belt fuser since the deformable belt, not the roll diameter, is the major contributor for generating the nip required for higher speed fixing of toner images. Smaller roll diameters also equate to more reliable stripping.

Fusing surface 30 of the belt 12 is elevated to fusing temperature by means of an internally heated roll 40 having a conventional quartz heater 42 disposed internally thereof. The roll 40 comprises a relatively thin (0.050 to 0.2 inch) walled metal structure chosen for its good heat conducting properties. To this end the roll 40 may be fabricated from aluminum or steel.

Another quartz heating structure 44 disposed internally of the roll 14 is provided for providing thermal energy only during fuser warm-up. By supplying the additional heat during warm-up the phenomena commonly referred to as droop is obviated.

A motor 48 operatively connected to the roll 14 through a conventional drive mechanism (not shown) provides for rotation of the roll 14. The frictional interface between the belt 12 and the roll 14 and between the belt 12 and the rolls 16 and 40 causes those rolls to be driven by the belt. Separate drive mechanisms (not shown) may be provided where necessary for imparting motion to the rolls 16, 20 and 40.

Figure 2:
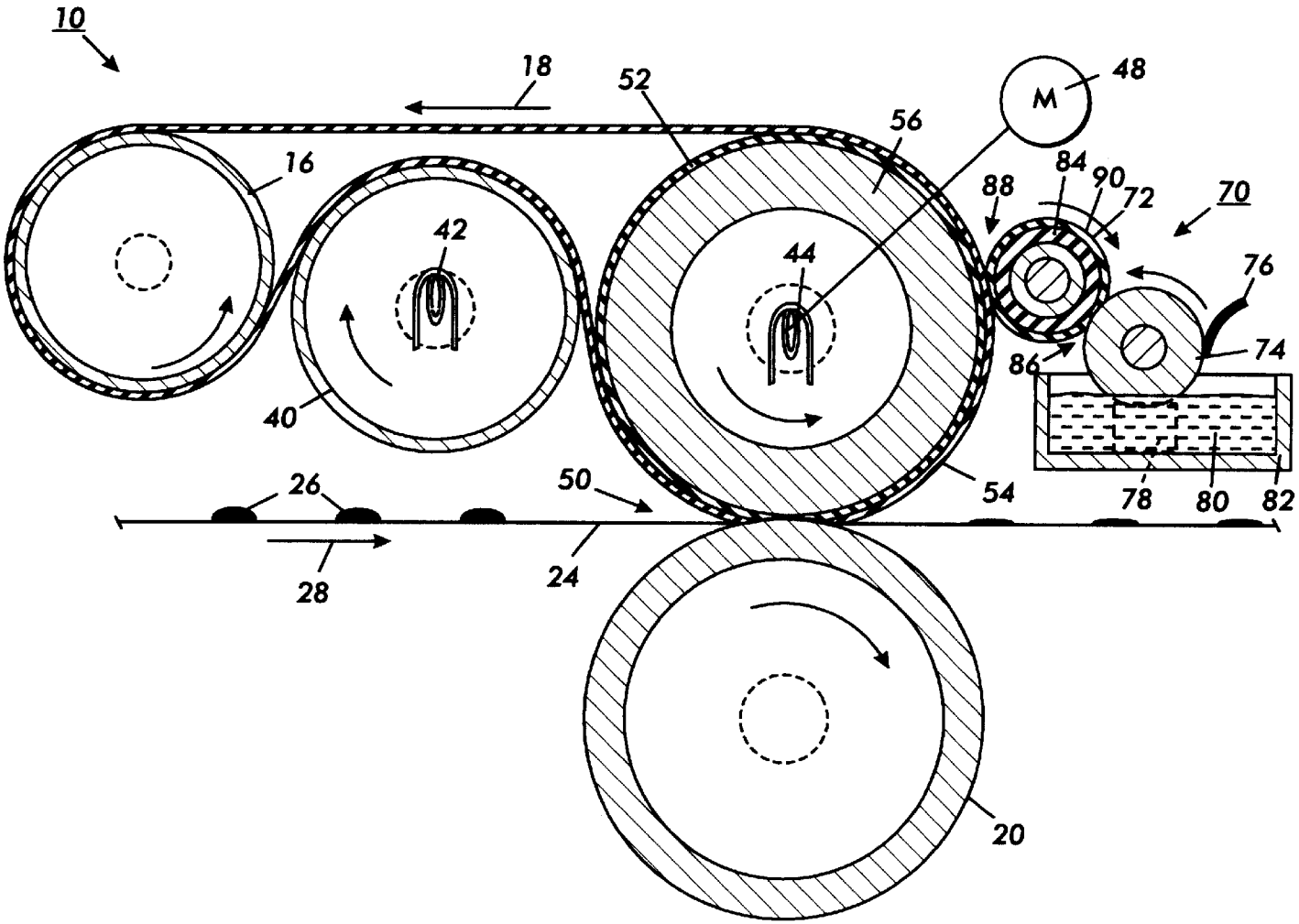
FIG. 2 is a schematic representation of another embodiment of the invention illustrated in FIG. 1.

As shown in FIG. 2, a heat and pressure belt fuser according to another embodiment of the invention may have a nip 50 created by a deformable layer 52 and a fusing belt 54. The layer 52 is carried by an internally heated roll structure. When both the pressure engageable roll 56 and fusing belt 54 are employed factors such as cost, energy transfer and belt flexibility must be considered. If the belt is provided with all of the nip forming elastomeric material and that layer is relatively thick then the belt would be too costly as well as too inflexible for its intended purpose. If the roll is provided with too much of a thermal barrier then the high fusing speeds contemplated by the invention can't be realized. Each layer may have a thickness in the order of 0.006 to inch. However, the combined thickness must also be in that range of values.

Figure 3:
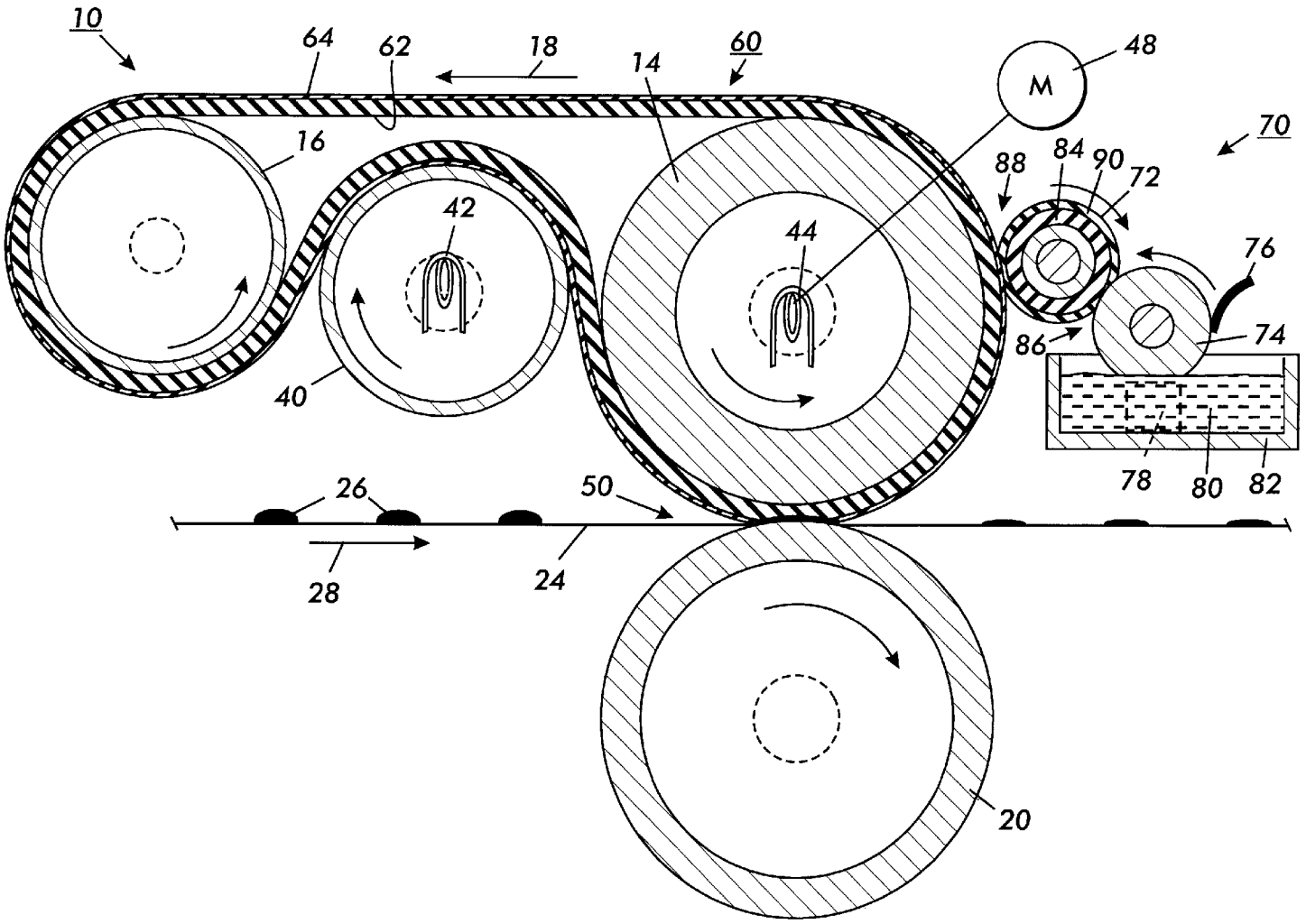
FIG. 3 is schematic representation of yet another embodiment of a heat and pressure belt fuser according to the invention.

As shown in FIG. 3, a fusing belt 60 may comprise a base layer 62 and an outer layer 64. The layer 64 comprises a 2 mil thick abhesive material such as VITON™.

For the purpose of coating the heated belt structure 12 in FIG. 2, there is provided a Release Agent Management (RAM) system generally indicated by reference character 70. The mechanism 70 comprises a donor roll 72, metering roll 74, doctor blade 76 and a wick 78. The metering roll 74 is partially immersed in the release agent material 80 and is supported for rotation such that it is contacted by the donor roll 72 which, in turn, is supported so as to be contacted by the fusing belt. As can be seen, the orientation of the rolls 72 and 74 is such as to provide a path for conveying material 80 from a sump 82 to the surface of the belt. The metering roll is preferably a nickel or chrome plated steel roll having a 4-32 M finish. The metering roll has an outside diameter of 1.0 to 1.5 inches. As mentioned above, the metering roll is supported for rotation, such rotation being derived by means of friction between the belt and the rotatably supported donor roll 72. In order to permit rotation of (at a practical input torque to the heated roll structure) the metering roll 74 in this manner the donor roll 72 comprises a deformable layer 84 which forms a first nip 86 between the metering roll and the donor roll and a second nip 88 between the latter and the heated roll. The nips 84 and 88 also permit satisfactory release agent transfer between the rolls and the belt. Suitable nip lengths are about 0.10 inch. A similar RAM system is provided for the heated belt structures 54 and 60 shown in FIGS. 2 and 3, respectively.

Wick 78 is fully immersed in the release agent and contacts the surface of the metering roll 74. The purpose of the wick is to provide an air seal which disturbs the air layer formed at the surface of the roll 74 during rotation thereof. If it were not for the function of the wick, the air layer would be coextensive with the surface of the roll immersed in the release agent thereby precluding contact between the metering roll and the release agent.

The blade 76 preferably fabricated from Viton is ¾×⅛ in cross section and has a length coextensive with the metering roll. The edge of the blade contacting the metering roll has a radius of 0.001–0.010 inch. The blade functions to meter the release agent picked up by the roll 74 to a predetermined thickness, such thickness being of such a magnitude as to result in several microliters of release agent consumption per copy. The donor roll 72 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer 84 of the donor roll preferably comprises overcoated silicone rubber. However, other materials may also be employed.

A thin sleeve 90 on the order of several mils, constitutes the outermost surface of the roll 72, the sleeve material comprises TEFLON™, VITON™ or any other material that will impede penetration of silicone oil into the silicone rubber. While the donor rolls may be employed without the sleeve 90, it has been found that when the sleeve is utilized, the integrity of the donor roll is retained over a longer period and contaminants such as lint on the belt will not readily transfer to the metering roll 74. Accordingly, the material in the sump will not become contaminated by such contaminants.

I claim:

1. A heat and pressure belt fuser structure, said fuser structure comprising:

a plurality of nip forming members including an elastic endless belt and a pair of pressure engageable members between which said elastic belt is sandwiched for forming a fusing nip through which substrates carrying toner images pass with said toner images contacting an outer surface of said elastic belt, at least one of said nip forming members comprising a deformable layer;

an external source of thermal energy for elevating a pre-nip area of said belt and;

means for elevating the temperature of one of said pressure engageable member during a warm-up period.

2. A heat and pressure belt fuser structure according to claim 1 wherein said plurality of nip forming members for forming said nip are supported for forming a single nip.

3. A heat and pressure belt fuser structure according to claim 2 wherein said elastic belt comprises a deformable layer and said pressure engageable members are rolls.

4. A heat and pressure belt fuser structure according to claim 3 wherein one of said pair of pressure engageable rolls comprises a deformable layer which cooperates with said deformable layer on said elastic belt to form said single nip.

5. The heat and pressure belt fuser according to claim 4 wherein said deformable layer of the elastic belt and the deformable layer of the one of the pair of pressure engageable rolls each have a thickness in the order of 0.006 to 0.125 inch and their combined thickness is equal to or less than 0.125 inch.

6. A method of fixing toner images including the steps of:

supporting a plurality of nip forming members including an elastic endless belt and a pair of pressure engageable members between which said elastic endless belt is sandwiched for forming a fusing nip through which substrates carrying toner images pass with said toner images contacting an outer surface of said elastic endless belt, at least one of said nip forming members comprising a deformable layer;

using an external source of thermal energy to elevate the temperature of the elastic endless belt in pre-nip area thereof; and evaluating the temperature of one of said pair of pressure engageable members during a warm-up period.

7. The method of fixing toner images according to claim 6 wherein said elastic endless belt comprises a deformable layer.

8. The method of fixing toner images according to claim 7 wherein said pair of pressure engageable members are rolls; and wherein a one of said pair of pressure engageable rolls comprises a deformable layer which cooperates with said deformable layer of said elastic endless belt to form said single nip.

9. The method of fixing toner images according to claim 8 wherein said plurality of nip forming members are supported for forming a single nip.

10. The method of fixing toner images according to claim 9 wherein said deformable layer of said elastic endless belt has a thickness in the order of 0.006 to 0.125 inch.

11. The method of fixing toner images according to claim 10 wherein said deformable layer of said one said pressure engageable rolls has a thickness such that the combined thickness of said deformable layer of said elastic endless belt and the deformable layer of said one of the pressure engageable rolls is equal to or less than 0.125 inch.

* * * * *